US006390832B1

(12) United States Patent
Kuo

(10) Patent No.: US 6,390,832 B1
(45) Date of Patent: May 21, 2002

(54) GROUNDED AND STIFFENED ELECTRICAL CARD CONNECTOR

(75) Inventor: Ming Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/800,681

(22) Filed: Mar. 6, 2001

(30) Foreign Application Priority Data

Dec. 21, 2000 (TW) ..... 089222272

(51) Int. Cl.[7] ..... H01R 13/652
(52) U.S. Cl. ..... 439/101; 439/541.5
(58) Field of Search ..... 439/541.5, 64, 439/101, 108

(56) References Cited

U.S. PATENT DOCUMENTS 5,636,999 A * 6/1997 Hirai et al. ..... 439/79
5,688,130 A * 11/1997 Huang ..... 439/541.5
5,795,190 A * 8/1998 Ono ..... 439/541.5
6,039,583 A * 3/2000 Korsunsky et al. ..... 439/101
6,116,925 A * 9/2000 Tung ..... 439/101
6,179,652 B1 * 1/2001 Tung et al. ..... 439/541.5

* cited by examiner

*Primary Examiner*—Gary Paumen
(74) *Attorney, Agent, or Firm*—WeiTe Chung

(57) ABSTRACT

An electrical card connector includes an upper insulative housing (20), a number of upper electrical terminals (22), an upper dielectric transitional element (4), a lower insulative housing (30) stacked below the upper insulative housing, a number of lower electrical terminals (32) and a lower dielectric transitional element (5). The upper electrical terminals are partially retained by the upper insulative housing and are partially received in the upper and lower dielectric transitional elements. The lower electrical terminals are partially received in the lower dielectric transitional element. A pair of elongated plates (6) are embedded in the lower dielectric transitional element.

1 Claim, 4 Drawing Sheets

GROUNDED AND STIFFENED ELECTRICAL CARD CONNECTOR

BACKGROUND OF THE INVENTION

1. Field of the Invention

The present invention relates to an electrical connector, and particularly to an electrical card connector which is indirectly electrically connected with a printed circuit board.

2. Description of the Related Art

Electrical card connectors are mounted on printed circuit boards to electrically connect electronic cards received therein with the printed circuit boards.

Means by which the electrical card connectors are electrically connected with the printed circuit boards are divided into two categories, i.e., directly connecting and indirectly connecting. Directly connecting relates to that electrical terminals of the electrical card connector are directly engaged with contacting pads on the printed circuit board while indirectly connecting means that electrical terminals of the electrical card connector are electrically engaged with electrical terminals of a transitional electrical connector which is in turn electrically connected with the printed circuit board.

U.S. Pat. No. 5,636,999 discloses an electrical card connector which is indirectly connected with a printed circuit board and comprises a transitional element accommodating transitional portions of electrical terminals of the electrical card connector in inner faces of opposite side walls thereof. A transitional electrical connector mounted on the printed circuit board is partially received in the transitional element of the electrical card connector thereby electrical terminals protruding from outer faces of opposite side walls of the transitional electrical connector are then electrically engaged with the transitional portions of the electrical terminals of the electrical card connector. The side walls of the transitional element of the electrical card connector will be plastic deformed after long-term insertion and/or ejection of the transitional electrical connector. Furthermore, pitches between every two adjacent electrical terminals of the electrical card connector is relatively small due to the high density thereof, therefore, the electrical terminals will be subject to cross talk of one another when the signal transmission speed between the two connectors increases to comply with the present developing trend toward faster signal transmission in the electronic field.

The plastic deformation of the transitional element of the electrical card connector and the cross talk between the electrical terminals of the electrical card connector deteriorate the signal transmission quality between the electrical card connector and the transitional electrical connector.

Therefore, an improved electrical card connector is desired to overcome the disadvantages of the prior art.

SUMMARY OF THE INVENTION

A first object of the present invention is to provide an electrical card connector which is effectively shielded from the cross talk between electrical terminals thereof; and A second object of the present invention is to provide an electrical card connector comprising a transitional element, which is mechanically stiffened to eliminate the plastic deformation thereof.

An electrical card connector in accordance with the present invention comprises an insulative housing, a plurality of electrical terminals retained in the insulative housing, a dielectric transitional element and an elongated metal plate embedded in the dielectric transitional element. The electrical terminals protrude beyond a forward side of the insulative housing to electrically engage with electrical terminals of a complementary electrical connector at an engaging portion thereof. The dielectric transitional element is assembled with the insulative housing and receives in inner faces of two opposite walls thereof a transitional portion of each electrical terminal protruding beyond a rearward side of the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
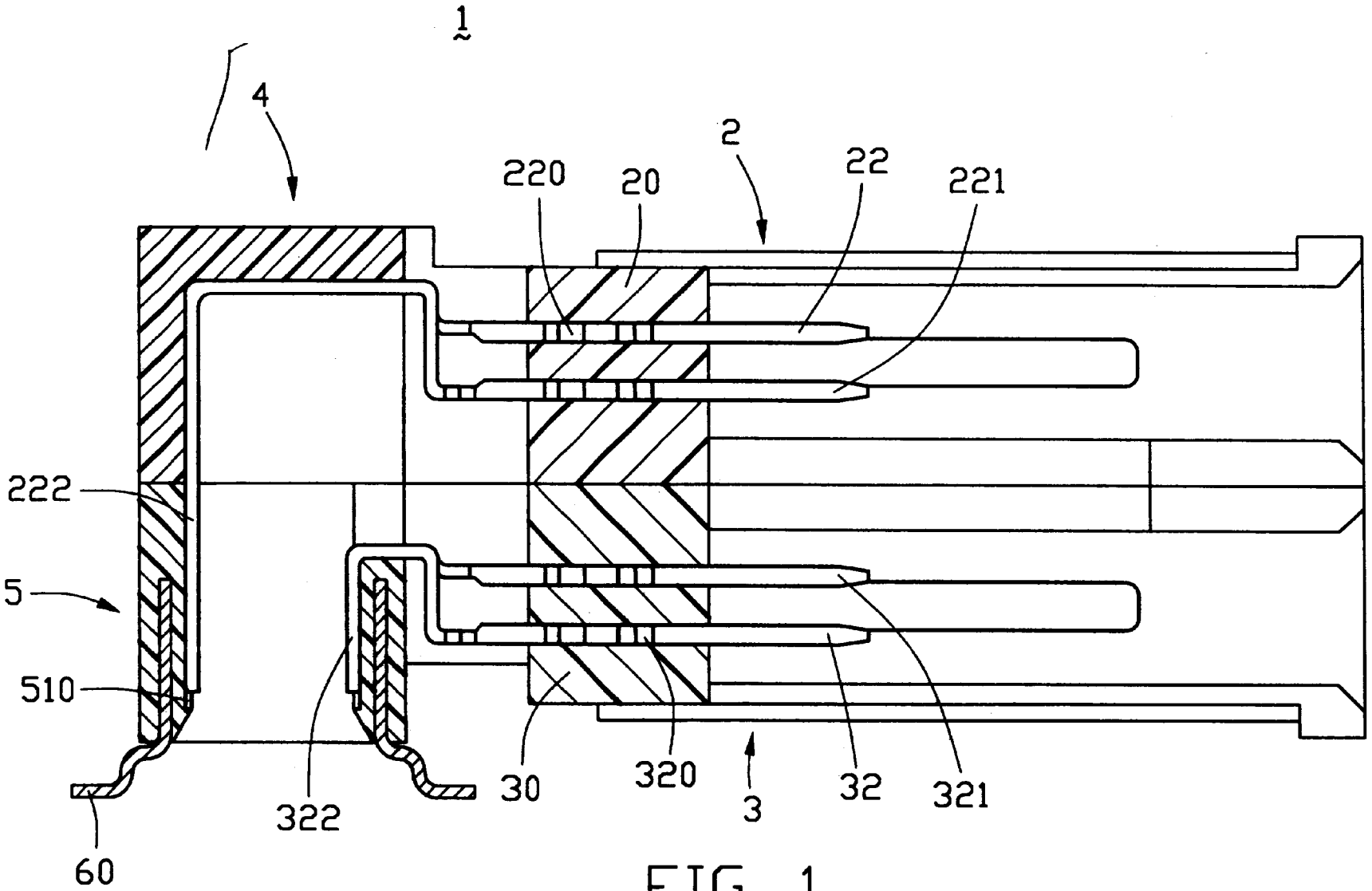
FIG. 1 is a cross-sectional view of an electrical card connector in accordance with a first embodiment of the present invention.
Figure 2:
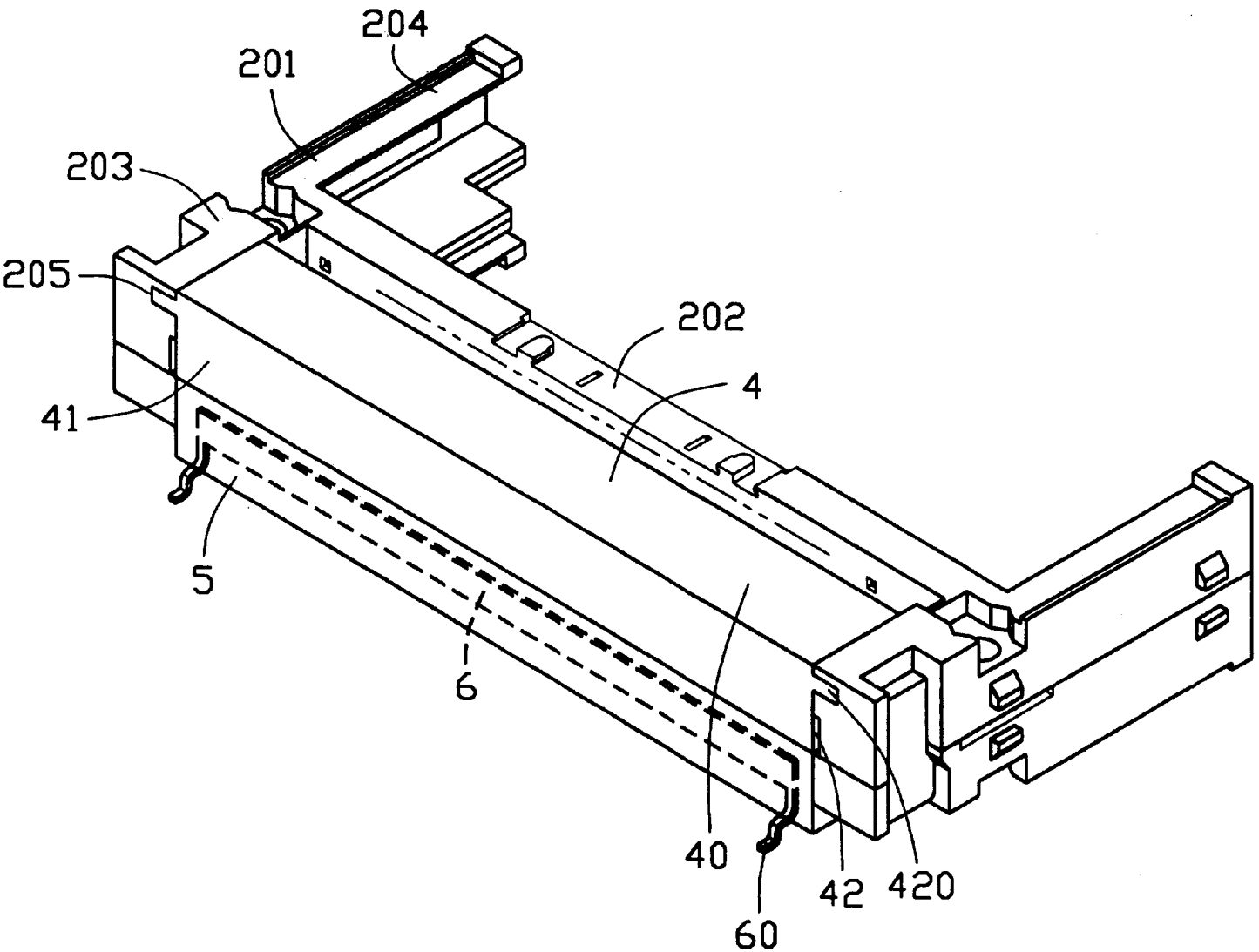
FIG. 2 is a perspective view of the electrical card connector of FIG. 1, wherein electrical terminals of the electrical card connector are not shown.
Figure 3:
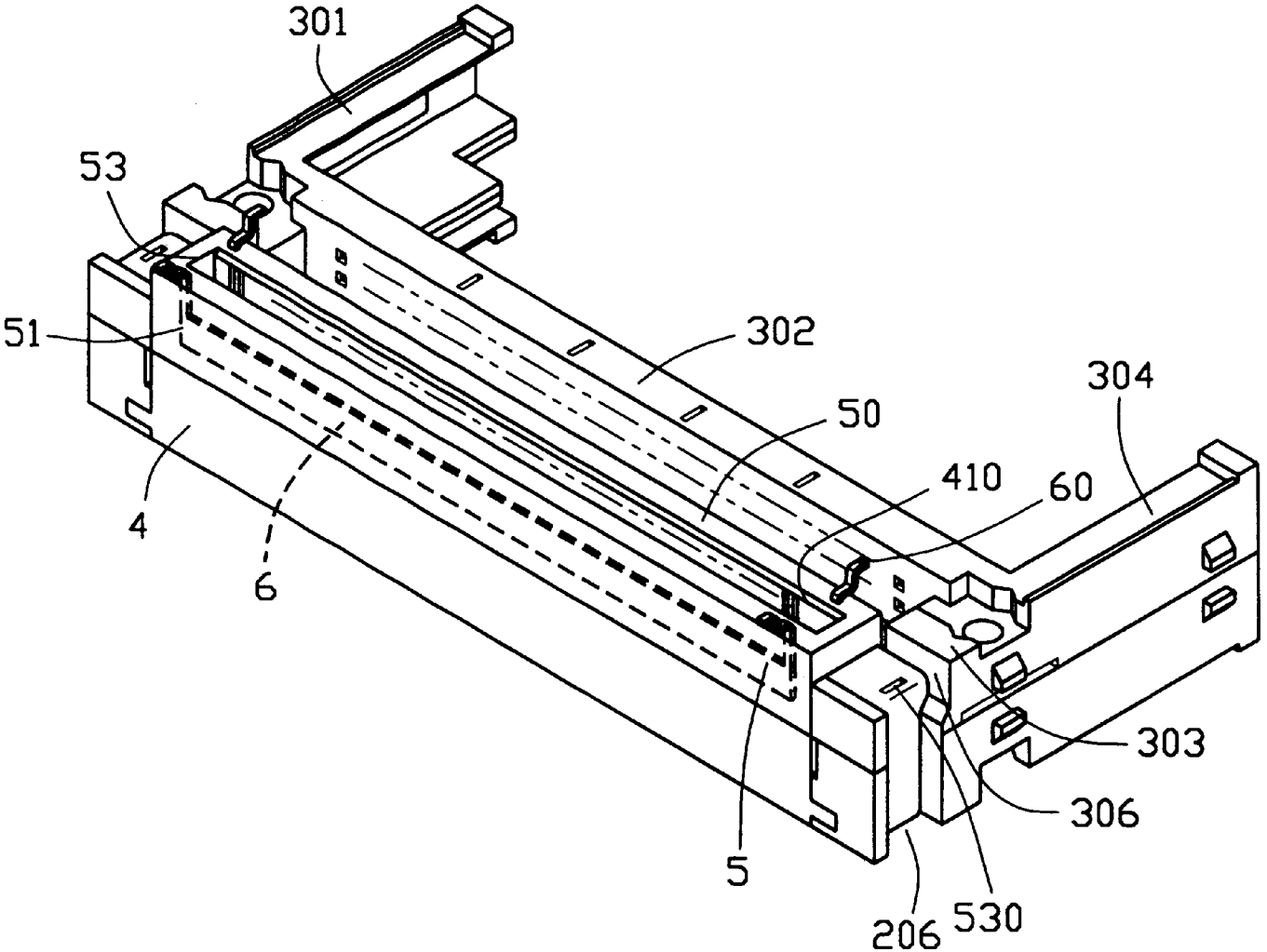
FIG. 3 is an inverted view of FIG. 2.

Referring to FIGS. 1 to 3, an electrical card connector 1 in accordance with a first embodiment of the present invention comprises an upper electrical card connector 2, a lower electrical card connector 3 stacked below the upper electrical card connector 2 and a pair of elongated plates 6.

The upper and lower electrical card connectors 2, 3 respectively comprise upper and lower insulative housings 20, 30, upper and lower electrical terminals 22, 32 and upper and lower dielectric transitional elements 4, 5.

The upper and lower insulative housings 20, 30 are similar in shape to each other and each comprises a pair of parallel arms 201, 301 and a header 202, 302 extending therebetween. Each arm 201, 301 of the upper and lower insulative housings 20, 30 comprises a mounting portion 203, 303 extending rearwardly beyond the header 202, 302 and a guiding portion 204, 304 extending forwardly beyond the header 202, 302. The mounting portions 203 of the arms 201 of the upper insulative housing 20 define a pair of opposing cutouts 205 extending along a direction along which the arms 201 extend in opposing inner faces thereof. Each mounting portion 203, 303 of the arms 201, 301 defines a retaining channel 206, 306 opened outwardly and communicating with each other.

The upper and lower electrical terminals 22, 32 each comprises a fixing portion 220, 320, an engaging portion 221, 321 and a transitional portion 222, 322. The fixing portions 220, 320 and the engaging portions 221, 321 all extend horizontally. The transitional portions 222, 322 extend firstly horizontally from the fixing portions 220, 320 and opposite to the engaging portions 221, 321, then vertically to be perpendicular to the fixing and engaging portions 220, 320, 221, 321, then horizontally again to be parallel to the fixing and engaging portions 220, 320, 221, 321, and lastly vertically again to be perpendicular to the fixing and engaging portions 220, 320, 221, 321. As known to all skilled in the pertinent art, some of the upper and lower electrical terminals 22, 32 are designated for grounding function and are thus called grounding terminals.

The upper dielectric transitional element 4 comprises a longitudinal upper top wall 40, a longitudinal upper rear wall 41 depending downwardly from a rear edge of the upper top wall 40 and a pair of opposite upper end walls 42. The upper end walls 42 connect the upper top and rear walls 40, 41 at top and rear edges thereof. A pair of ribs 420 protrude from outer faces of the opposite upper end walls 42 adjacent to the top edges thereof. The upper top and rear walls 40, 41 each defines a plurality of upper terminal passageways (not shown). Each upper terminal passageway of the upper top wall 40 communicates with a corresponding upper terminal passageway of the upper rear wall 41. A number of the upper terminal passageways of the upper top wall 40 is equal to that of the upper terminal passageways of the upper rear wall 41 and is equal to that of the upper electrical terminals 22.

The lower dielectric transitional element 5 comprises longitudinal opposite lower front and lower rear walls 50, 51 and opposite lower end walls 53 connecting the opposite lower front and lower rear walls 50, 51. A pair of L-shaped latches 530 extend from outer faces of the opposite lower end walls 53 and each has a free end spaced from and extending parallel to the lower end walls 53. The lower front and rear walls 50, 51 each defines a plurality of lower terminal passageways 510 in an inner face thereof. A number of the lower terminal passageways 510 of the lower rear wall 51 is equal to that of the lower terminal passageways 510 of the lower front wall 50 and is equal to that of the upper terminal passageways of the upper top wall 40 of the upper dielectric transitional element 4.

Each of the elongated plates 6 is made of conductive metal. Each elongated metal plate 6 forms a pair of feet 60 extending downwardly at opposite ends thereof.

In assembly, the fixing portions 220, 320 of the upper and lower electrical terminals 22, 32 are retained in the headers 202, 302 of the upper and lower insulative housings 20, 30. The engaging portions 221, 321 of the upper and lower electrical terminals 22, 32 extend forwardly beyond the headers 202, 302 and between the guiding portions 204, 304 of the arms 201, 301. The transitional portions 222, 322 extend rearwardly beyond the headers 202, 302 and between the mounting portions 203, 303.

The ribs 420 of the upper dielectric transitional element 4 are received in the cutouts 205 of the mounting portions 203 of the arms 201 of the upper insulative housing 20 to assemble the upper dielectric transitional element 4 to the mounting portions 203 of the upper insulative housing 20. The transitional portions 222 of the upper electrical terminals 22 extend through and are retained by the upper terminal passageways of the upper top and rear walls 40, 41 of the upper dielectric transitional element 4.

The latches 530 of the lower dielectric transitional element 5 extend from the channels 306 of the lower insulative housing 30 into the channels 206 of the upper insulative housing 20 and are retained in the channels 206, 306. The transitional portions 222 of the upper electrical terminals 22 further extend into the lower terminal passageways 510 of the lower rear wall 51 of the lower dielectric transitional element 5 and the transitional portions 322 of the lower electrical terminals 32 are received in the lower terminal passageways 510 of the lower front wall 50 of the lower dielectric transitional element 5, respectively. The pair of elongated metal plates 6 are embedded in the lower front and rear walls 50, 51 of the lower dielectric element 5 with the feet 60 thereof extending beyond the lower front and rear walls 50, 51 to be contacted with grounding pads on a printed circuit board (not shown) when the electrical card connector 1 is mounted to the printed circuit board.

Figure 4:
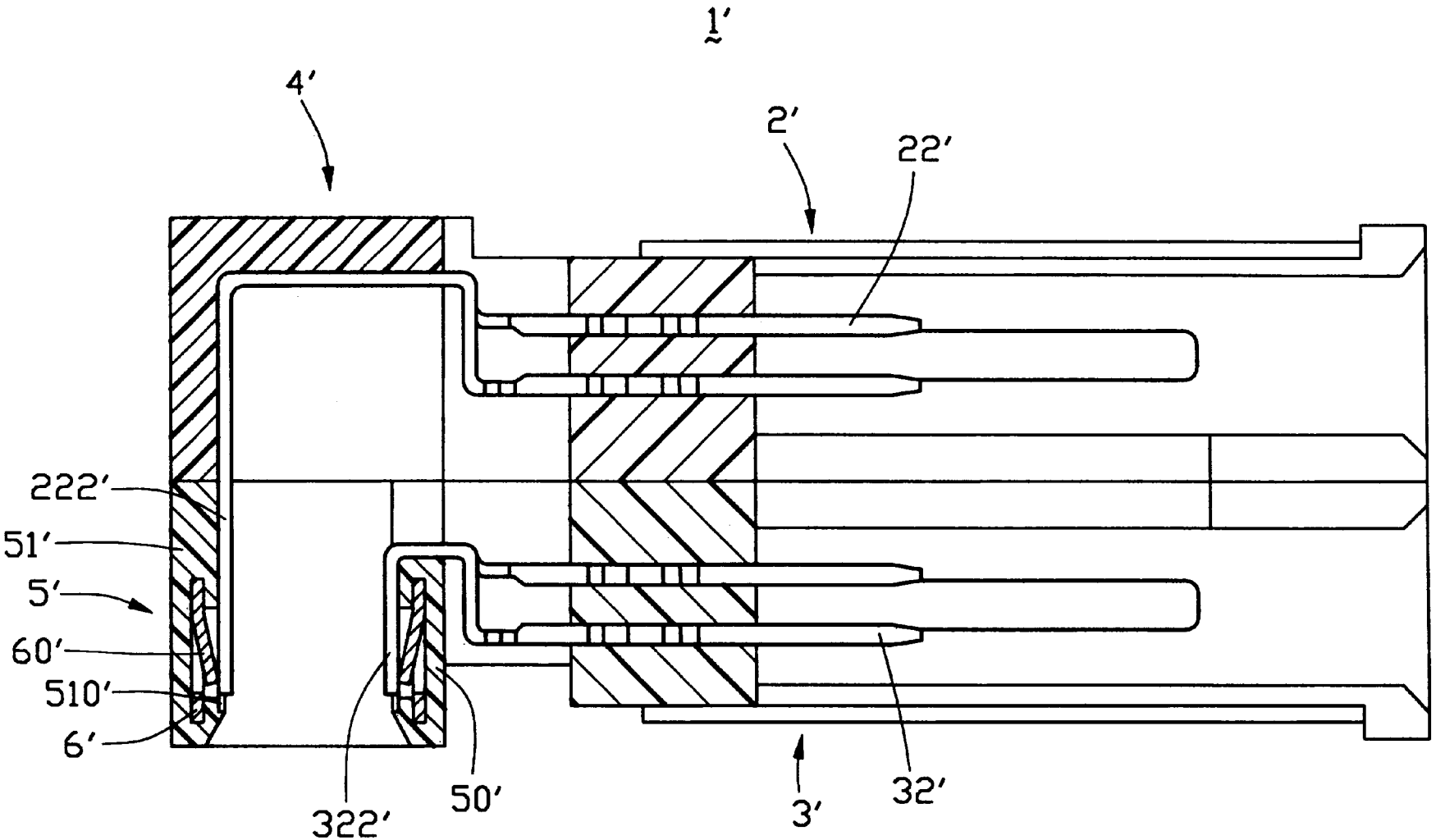
FIG. 4 is a cross-sectional view of an electrical card connector in accordance with a second embodiment of the present invention.

Referring to FIG. 4, an electrical card connector 1' in accordance with a second embodiment of the present invention is similar to the electrical card connector 1 of the first embodiment, so like reference numerals are applied to like components hereafter. The elongated metal plates 6' embedded in the lower front and rear walls 50', 51' of the lower dielectric transitional element 5' each comprise a plurality of tabs 60' protruding into lower terminal passageways 510' and electrically contacting with transitional portions 222', 322' of selected upper and lower grounding terminals 22', 32'.

The elongated metal plates 6, 6' provide grounding functions to the electrical card connectors 1, 1' and complementary transitional electrical connectors (not shown) which comprises electrical terminals electrically connecting with the transitional portions 222, 222', 322, 322' of the upper and lower electrical terminals 22, 22', 32, 32'. Further, since the elongated plates 6, 6' are made of metal and are embedded in the lower front and rear walls 50, 50', 51, 51', the walls 50, 50', 51, 51' are mechanically stiffened by the elongated metal plates 6, 6'.

The electrical card connector 1, 1' may also have only one insulative housing and one dielectric transitional element receiving electrical terminals thereof extending beyond the insulative housing and partially embedding an elongated metal plate therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

a first insulative housing comprising a pair of parallel arms and a header extending therebetween;

a first dielectric transitional element comprising a first top wall and a first rear wall;

a plurality of first electrical terminals each comprising a fixing portion retained in the header of the first insulative housing, an engaging portion extending forwardly beyond the header of the first insulative housing and a transitional portion extending rearwardly beyond the header of the first insulative housing and through the first top and rear walls;

a second insulative housing comprising a pair of parallel arms and a header extending therebetween;

a second dielectric transitional element comprising a second front wall and a second rear wall receiving the transitional portions of the first electrical terminals;

a plurality of second electrical terminals each comprising a fixing portion retained in the header of the second insulative housing, an engaging portion and a transitional portion partially received in the second front wall of the second dielectric transitional element; and a pair of elongated plates are partially embedded in the second front and rear walls of the second dielectric transitional element, respectively;

wherein the elongated plates are made of metal and each has a pair of feet extending from opposite ends thereof beyond the second front and rear walls of the second dielectric transitional element, respectively;

wherein the elongated plates each have a plurality of tabs electrically contacting with selected ones of the first and second electrical terminals for grounding;

wherein each arm of the first and second insulative housings comprises a mounting portion extending rearwardly beyond the corresponding header and a guiding portion extending forwardly beyond the corresponding header, the engaging portions of the first and second electrical terminals extending between the guiding portions of the arms and the transitional portions of the first and second electrical terminals extending between the mounting portions of the arms;

wherein the first dielectric transitional element comprises the first top wall, the first rear wall and a pair of first end walls, the first end walls each having a rib thereon and the mounting portions of the arms of the first insulative housing defining a pair of cutouts receiving the ribs;

wherein the second dielectric transitional element comprises the second front and rear walls and a pair of second end walls, the mounting portions of the arms of the first and second insulative housing each defining a channel therein and the second end walls each having a latch extending from the channels of the second insulative housing into the channels of the first insulative housing and being retained in the channels.

* * * * *